US008033961B2

(12) United States Patent
Kuo

(10) Patent No.: US 8,033,961 B2
(45) **Date of Patent: *Oct. 11, 2011**

(54) ATHLETIC APPARATUS WITH NON-LINEAR SLIDING TRACK

(75) Inventor: Hai Pin Kuo, Tainan (TW)

(73) Assignee: Sports Art Industrial Co., Ltd., Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/798,585

(22) Filed: Apr. 8, 2010

(65) Prior Publication Data

US 2010/0197466 A1 Aug. 5, 2010

Related U.S. Application Data

(63) Continuation-in-part of application No. 12/251,466, filed on Oct. 15, 2008, now abandoned.

(51) Int. Cl.
*A63B 22/04* (2006.01)
*A63B 71/00* (2006.01)

(52) U.S. Cl. ..... 482/52; 482/51

(58) Field of Classification Search ..... 482/51–53, 482/57, 62, 70, 79–80
See application file for complete search history.

(56) References Cited

U.S. PATENT DOCUMENTS 4,781,372 A 11/1988 McCormack
5,314,392 A * 5/1994 Hawkins et al. ..... 482/57
5,741,205 A 4/1998 Doll et al.
5,910,072 A * 6/1999 Rawls et al. ..... 482/51
6,004,244 A * 12/1999 Simonson ..... 482/52
6,126,573 A * 10/2000 Eschenbach ..... 482/51
6,168,552 B1 * 1/2001 Eschenbach ..... 482/52
6,210,305 B1 * 4/2001 Eschenbach ..... 482/52
6,422,977 B1 * 7/2002 Eschenbach ..... 482/52
6,440,042 B2 * 8/2002 Eschenbach ..... 482/52
6,689,019 B2 * 2/2004 Ohrt et al. ..... 482/52
6,849,033 B1 * 2/2005 Stearns et al. ..... 482/52
7,014,595 B2 3/2006 Bruno
7,278,955 B2 * 10/2007 Giannelli et al. ..... 482/51
7,341,542 B2 * 3/2008 Ohrt et al. ..... 482/52
7,462,134 B2 * 12/2008 Lull et al. ..... 482/52
7,479,093 B1 * 1/2009 Immordino et al. ..... 482/52
7,568,999 B2 * 8/2009 Giannelli et al. ..... 482/51
7,582,043 B2 * 9/2009 Liao et al. ..... 482/52
7,594,877 B2 * 9/2009 Anderson et al. ..... 482/52
7,618,350 B2 * 11/2009 Dalebout et al. ..... 482/52
7,621,849 B1 * 11/2009 Tsai ..... 482/52
7,632,219 B2 * 12/2009 Ohrt et al. ..... 482/52
7,637,848 B1 * 12/2009 Chang ..... 482/51
7,654,936 B2 * 2/2010 Liao et al. ..... 482/52
7,674,205 B2 * 3/2010 Dalebout et al. ..... 482/52
(Continued)

*Primary Examiner* — Stephen Crow
(74) *Attorney, Agent, or Firm* — Charles E. Baxley

(57) ABSTRACT

An athletic apparatus includes two rotary wheels installed on a frame, a pair of tracks disposed on the frame and tilted relative to the frame, a pair of pedal mechanisms slidably attached to the tracks and each having a pedal, a pair of rocker arm mechanisms having upper ends attached to the axle rod and lower ends coupled to the pedal mechanisms, a pulley attached to the frame and a steel rope engaged with the pulley and coupled to the pedal mechanisms, two linking belts coupling the lower ends of the rocker arms to an elastic belt which is engaged with the rotary wheels, a belt wheel and two gear wheels installed on a shaft rod of the frame, and the tracks are curved and tilted or inclined relative to the frame.

9 Claims, 7 Drawing Sheets

U.S. PATENT DOCUMENTS

| | | | | |
|---|---|---|---|---|
| 7,682,290 | B2 * | 3/2010 | Liao et al. | 482/52 |
| 7,736,278 | B2 * | 6/2010 | Lull et al. | 482/52 |
| 7,740,564 | B2 * | 6/2010 | Shen | 482/52 |
| 7,744,508 | B2 * | 6/2010 | Liao et al. | 482/52 |
| 7,771,324 | B2 * | 8/2010 | Anderson et al. | 482/52 |
| 7,775,940 | B2 * | 8/2010 | Dalebout et al. | 482/52 |
| 7,780,580 | B2 * | 8/2010 | Eschenbach | 482/62 |
| 7,806,808 | B2 * | 10/2010 | Kuo | 482/52 |
| 2004/0224825 | A1 * | 11/2004 | Giannelli et al. | 482/52 |
| 2006/0040794 | A1 * | 2/2006 | Giannelli et al. | 482/51 |
| 2006/0264301 | A1 * | 11/2006 | Kuo | 482/52 |
| 2006/0293153 | A1 * | 12/2006 | Porth et al. | 482/52 |
| 2007/0099763 | A1 * | 5/2007 | Wang | 482/52 |
| 2007/0161464 | A1 * | 7/2007 | Chiles et al. | 482/52 |
| 2007/0219063 | A1 * | 9/2007 | Anderson et al. | 482/52 |
| 2007/0219065 | A1 * | 9/2007 | Anderson et al. | 482/52 |
| 2008/0261780 | A1 * | 10/2008 | Giannelli et al. | 482/52 |
| 2008/0287265 | A1 * | 11/2008 | Giannelli et al. | 482/52 |
| 2008/0312044 | A1 * | 12/2008 | Chen et al. | 482/52 |
| 2008/0312045 | A1 * | 12/2008 | Lull et al. | 482/52 |
| 2009/0062081 | A1 * | 3/2009 | Liao et al. | 482/52 |
| 2010/0022357 | A1 * | 1/2010 | Anderson et al. | 482/52 |
| 2010/0093497 | A1 * | 4/2010 | Kuo | 482/52 |
| 2010/0093498 | A1 * | 4/2010 | Fenster et al. | 482/52 |
| 2010/0151999 | A1 * | 6/2010 | Kuo | 482/52 |
| 2010/0152000 | A1 * | 6/2010 | Giannelli et al. | 482/52 |

* cited by examiner

ATHLETIC APPARATUS WITH NON-LINEAR SLIDING TRACK

The present invention is a continuation-in-part of U.S. patent application Ser. No. 12/251,466, filed 15 Oct. 2008, now abandoned and to be abandoned.

BACKGROUND OF THE INVENTION

1. Field of the Invention

The present invention relates to an athletic apparatus, and more particularly to an athletic apparatus including a pair of non-linear sliding tracks movable relative to the supporting base and having a pair of foot pedals slidably attached or mounted on the tracks for supporting the user's legs or feet and for allowing the user to conduct an elliptical moving exercise or operation.

2. Description of the Prior Art

Typical athletic apparatuses or exercise devices comprise a pair of rotatably positionable tracks each having a stirrup movable back and forth thereon for supporting the user's legs or feet and for allowing the user to conduct sliding or skiing or skating or other types of exercise operations.

For example, U.S. Pat. No. 4,781,372 to McCormack discloses one of the typical ice-skating exercise devices comprising a pair of rotatably positionable and angularly adjustable tracks, and a pair of foot pedals slidably attached or mounted on the tracks for supporting the user's legs or feet.

However, the tracks are supported horizontally relative to the supporting base and the foot pedals may not be moved along an elliptical moving stroke.

U.S. Pat. No. 5,741,205 to Doll et al. discloses another typical exercise apparatus comprising a pair of pedal members rotatably attached or mounted to a supporting base, and a pair of foot pedals rotatably attached or mounted to the pedal members and coupled to the supporting base with pulleys and cables for keeping the vertical motion of the foot pedals.

However, the foot pedals and the pedal members may only be moved or stepped up and down relative to the supporting base, but may not be moved along an elliptical moving stroke.

U.S. Pat. No. 7,014,595 to Bruno discloses a further typical exercise apparatus or ice-skating apparatus comprising a pair of movable pedal members slidably attached or mounted along stride paths for simulating ice-skating exercises.

However, the pedal members may only be moved along the stride paths as an ice-skating exercise, but may not be moved along an elliptical moving stroke.

The present invention has arisen to mitigate and/or obviate the afore-described disadvantages of the conventional athletic apparatuses.

SUMMARY OF THE INVENTION

The primary objective of the present invention is to provide an athletic apparatus including a pair of non-linear sliding tracks movable relative to the supporting base and having a pair of foot pedals slidably attached or mounted on the tracks for supporting the user's legs or feet and for allowing the user to conduct an elliptical moving exercise or operation.

In accordance with one aspect of the invention, there is provided an athletic apparatus comprising a frame including an axle rod, two rotary wheels rotatably installed on the frame, a pair of tracks disposed on the frame and tilted relative to the frame for a predetermined angle, and each track including a curved and non-linear structure, a pair of pedal mechanisms slidably attached to the tracks and movable along the tracks respectively, and each including a pedal for supporting a user's feet, a pair of rocker arm mechanisms each including a rocker arm having an upper end pivotally attached to the axle rod of the frame and having a lower end pivotally coupled to the pedal mechanisms respectively, a first transmitting mechanism including a pulley attached to the frame and located below upper ends of the tracks, and a steel rope engaged with the pulley and having two ends coupled to the pedal mechanisms respectively for pivotally coupling the pedal mechanisms together and for guiding the pedal mechanisms to move up and down along the tracks respectively, a second transmitting mechanism including two linking belts each having a first end coupled to the lower ends of the rocker arms respectively and each having a second end coupled to an elastic belt, and the elastic belt being engaged with the rotary wheels of the frame for allowing the lower ends of the rocker arms to be coupled together with the linking belts and the elastic belt, a shaft rod installed on the frame, a belt wheel installed on the shaft rod, two gear wheels installed on the shaft rod with unidirectional bearings and engaged with the linking belts respectively.

The frame includes a base having a front bottom rod and a rear bottom rod and a middle bottom rod, a standing rod extended upwardly from the base, a control panel disposed on top of the standing rod, the axle rod is attached to the standing rod, a pair of handles attached to the axle rod and the middle bottom rod, and the rear bottom rod includes two installation portions.

The frame includes an inclined supporting rod, and the upper ends of the tracks are fixed to the inclined supporting rod, and the tracks include the lower ends fixed to the installation portions of the frame for suitably supporting the tracks at a tilted angle relative to the frame.

The lower ends of the rocker arms are each pivotally coupled to a linking rod with a universal connector, and the linking rods are pivotally coupled to the pedal mechanisms with universal connectors respectively.

The pedal mechanisms each include a pedal base slidably attached on the tracks and movable along the tracks respectively, and each include a supporter for attaching the pedal on the pedal base. The tracks each include a pair of curved pipes which are parallel to each other, and the pedals are preferably tilted relative to the pedal bases for a tilted angle.

A damping mechanism may further be provided and includes a load wheel rotatably installed on the frame and coupled to the belt wheel with a transmitting belt for coupling the load wheel to the belt wheel and for allowing the load wheel to be rotated relative to the frame by the belt wheel and the shaft rod and for providing a resistive force to the rocker arms, and an electro-magnetic brake is installed on the frame and located near the load wheel for braking the load wheel.

The frame includes a center line formed between the tracks, and the tracks each include an arc length having a curvature center and a radius respectively, and the radii and the arc lengths of the tracks are equal to each other, and the upper ends of the tracks are located close to each other, and the tracks include lower ends located away from each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
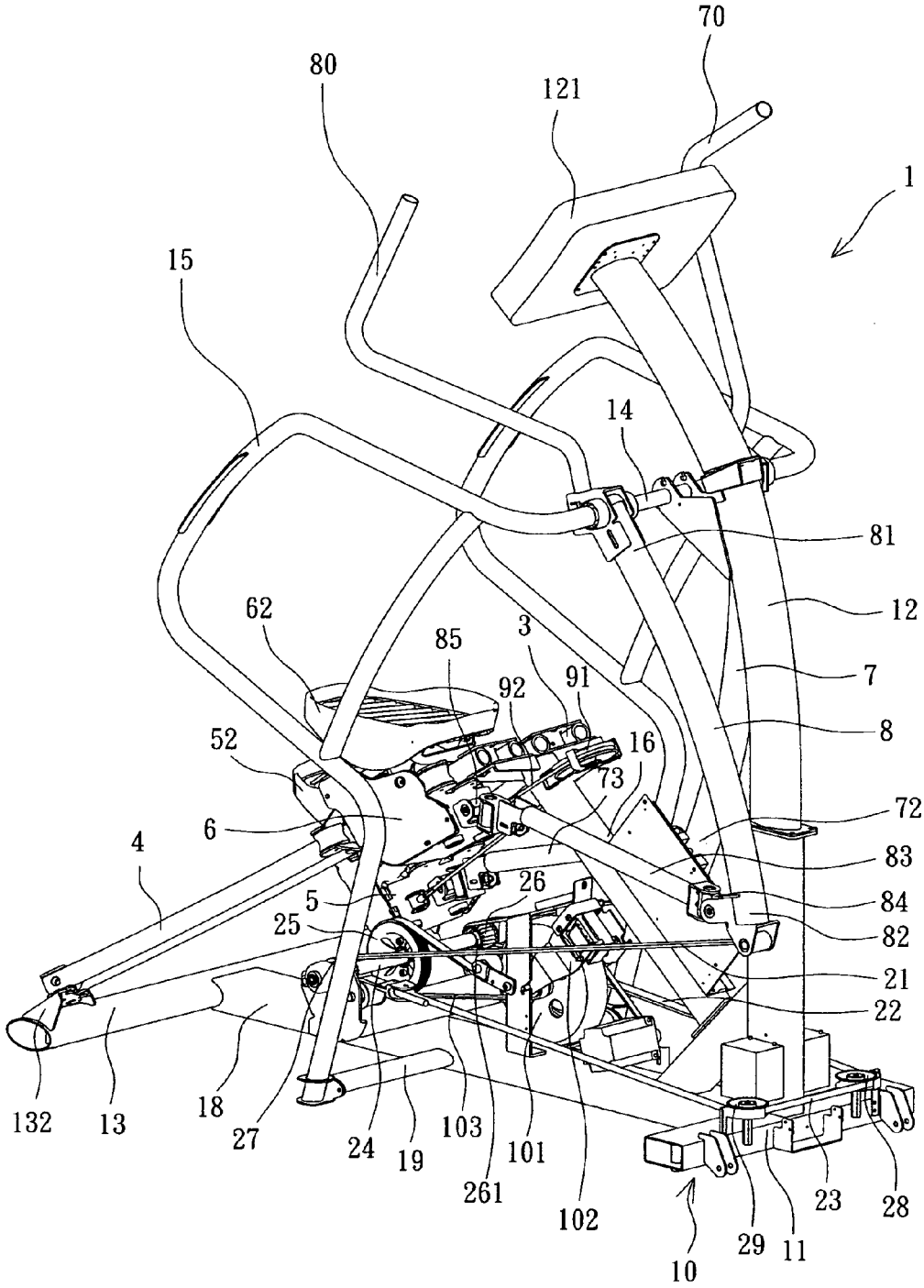
FIG. 1 is a front perspective view of an athletic apparatus in accordance with the present invention.
Figure 2:
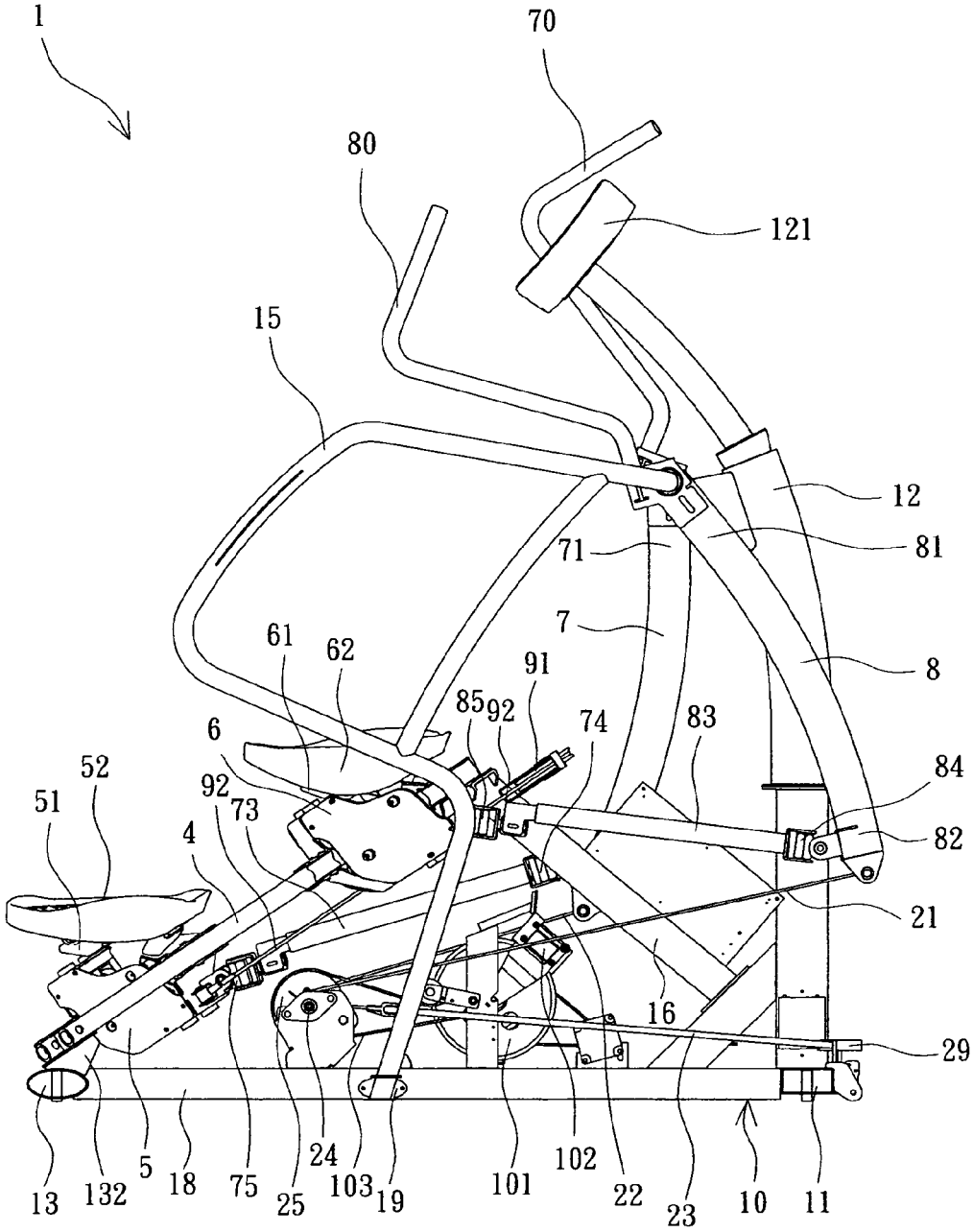
FIG. 2 is a left side plan schematic view of the athletic apparatus.
Figure 3:
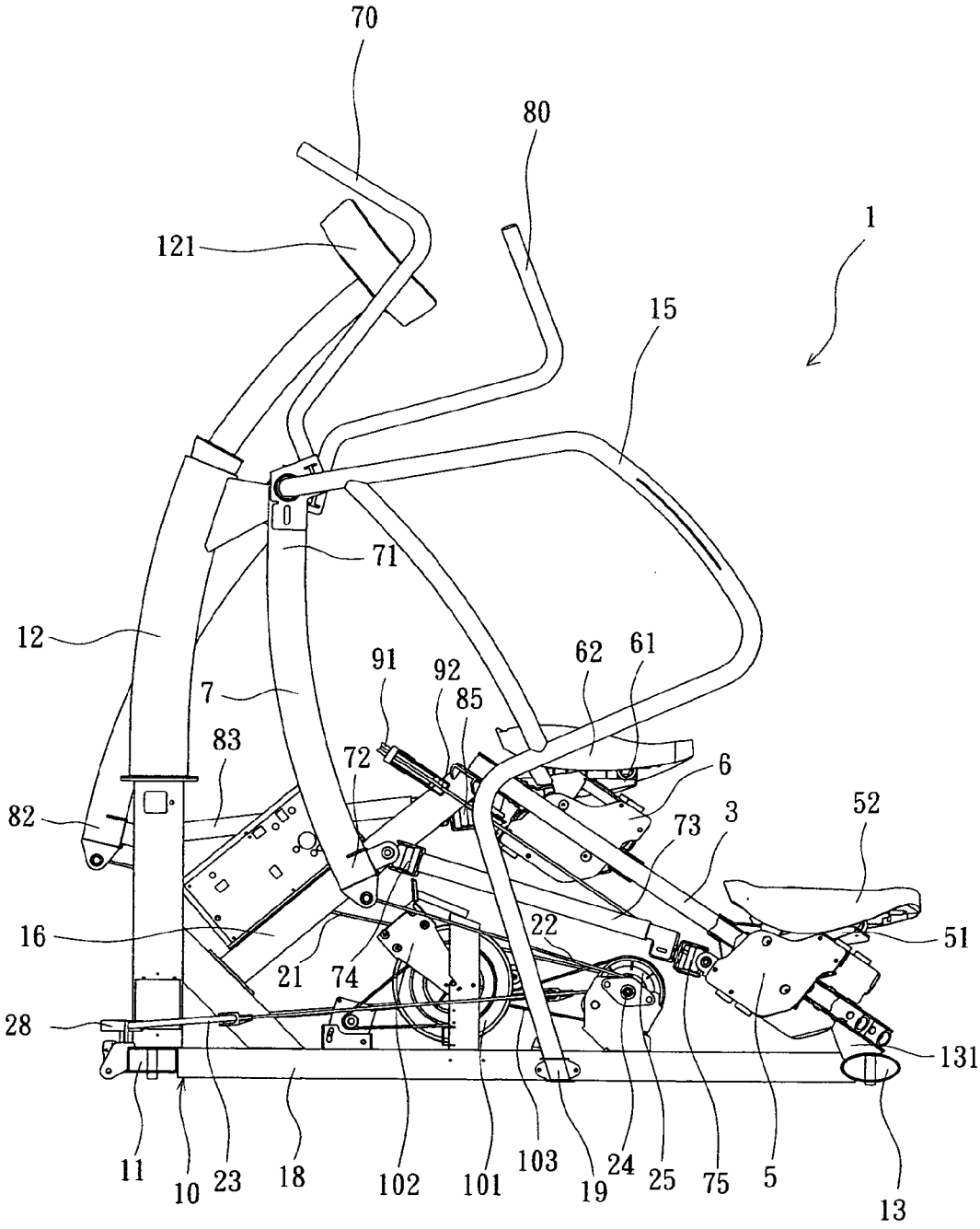
FIG. 3 is a right side plan schematic view of the athletic apparatus.

Referring to the drawings, and initially to FIGS. 1-3 and 8, an athletic apparatus 1 in accordance with the present invention comprises a frame 10 including a supporting base 18 having a front bottom rod 11 and a rear bottom rod 13 and a middle bottom rod 19, a standing rod 12 extended upwardly from the supporting base 18 or the front bottom rod 11, a control panel 121 disposed on top of the standing rod 12 for controlling or operating the athletic apparatus 1, an axle rod 14 attached or mounted or secured to the standing rod 12 and located at the upper portion of the standing rod 12 and laterally extended relative to the standing rod 12, a pair of handles 15 attached or mounted to the side portions of the axle rod 14 and the middle bottom rod 19 for being grasped or held by the users, and the rear bottom rod 13 includes two installation portions 131, 132 attached or mounted to the side or end portions thereof.

Figure 4:
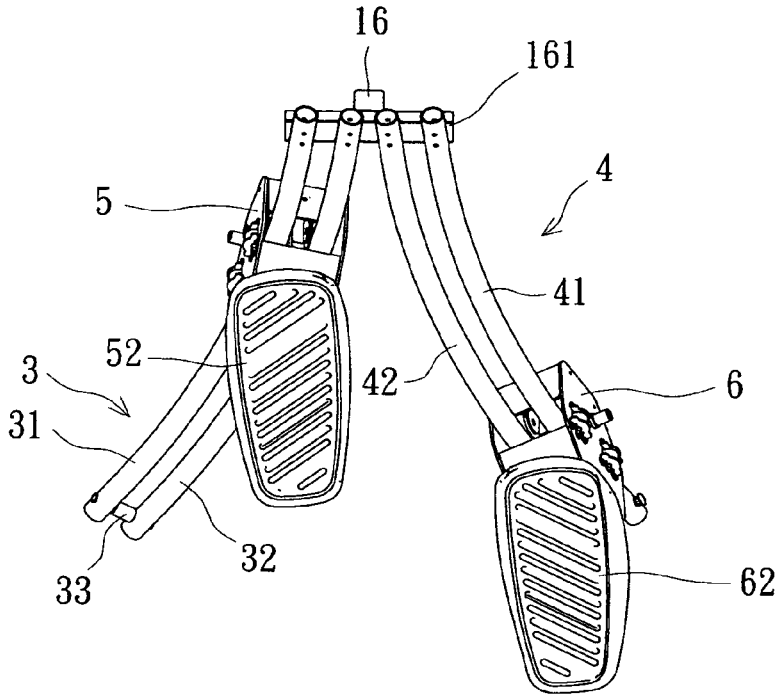
FIG. 4 is a partial top plan schematic view illustrating the tracks and the pedals of the athletic apparatus.
Figure 5:
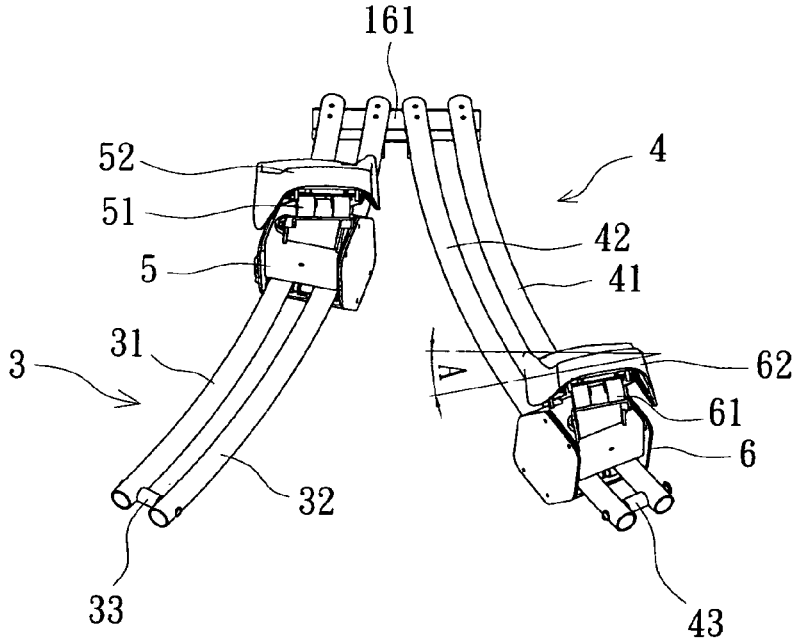
FIG. 5 is a partial rear plan schematic view illustrating the tracks and the pedals of the athletic apparatus.
Figure 7:
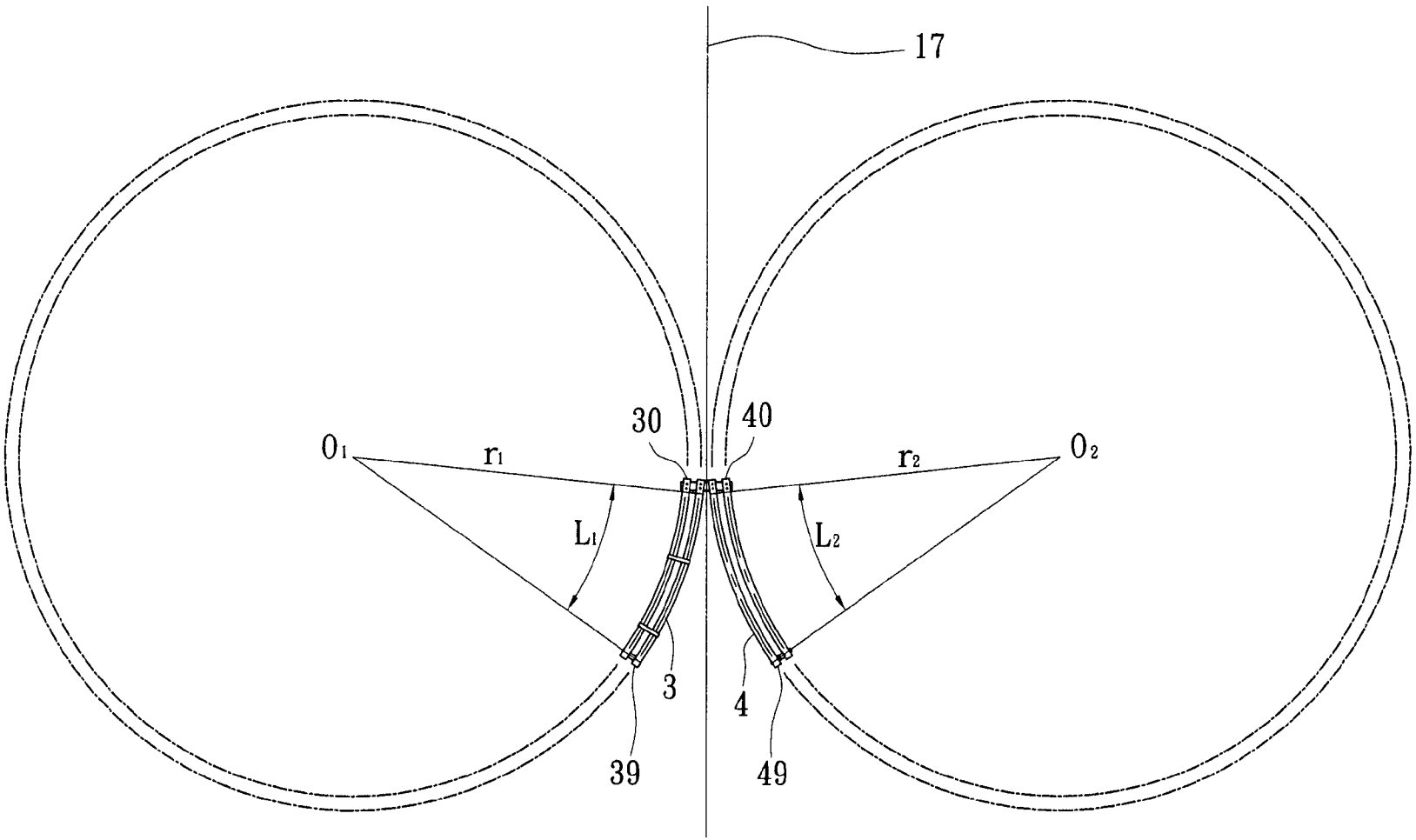
FIG. 7 is a plan schematic view illustrating the configuration of the tracks.
Figure 8:
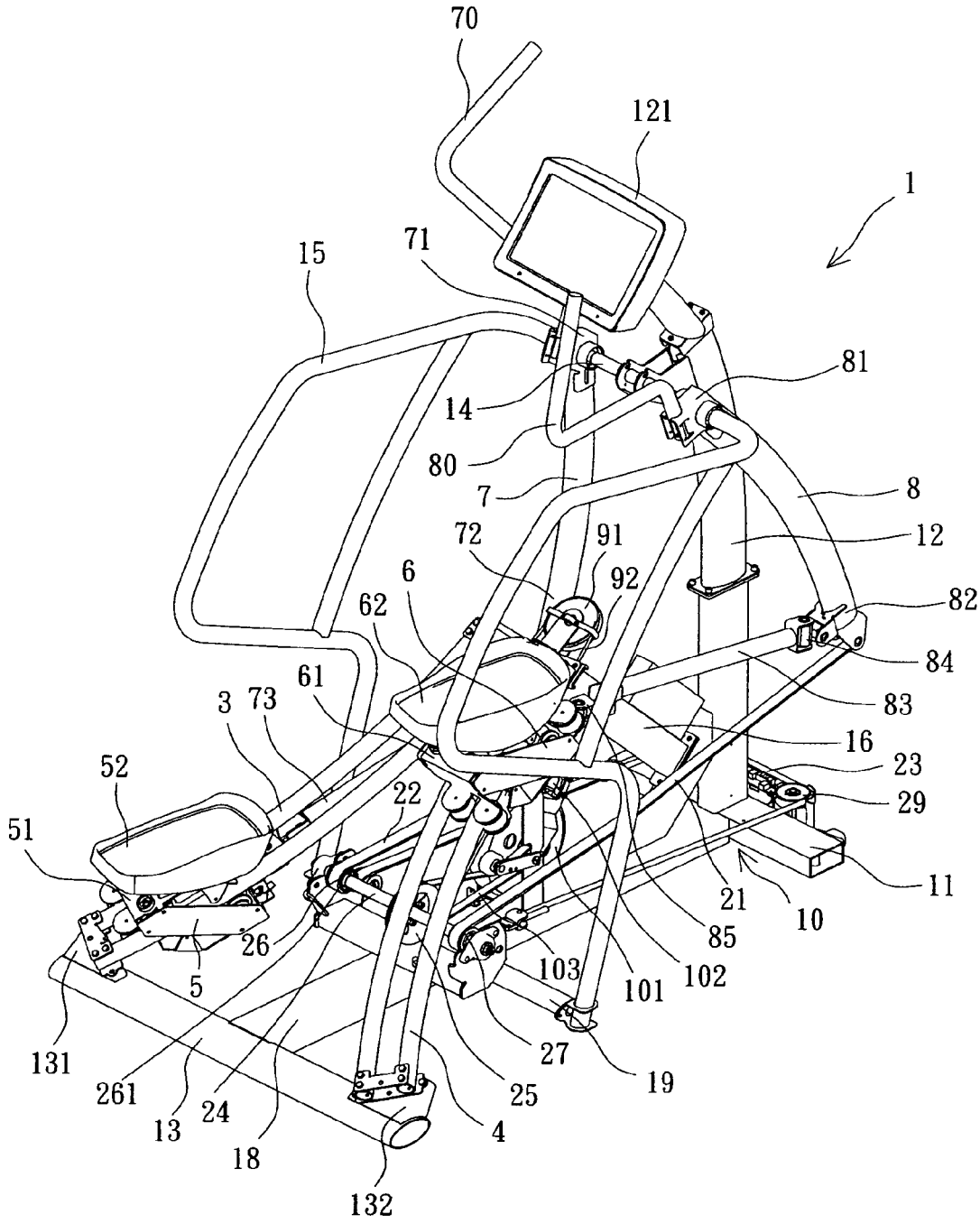
FIG. 8 is a rear perspective view illustrating the operation of the athletic apparatus.

A pair of separated tracks 3, 4 are disposed oppositely on the frame 10 and are mirror symmetric to each other and include bottom ends fixed or attached or mounted to the installation portions 131, 132 of the rear bottom rod 13 or of the frame 10, and include upper ends fixed or attached or mounted to an inclined supporting rod 16 of the frame 10 for allowing the tracks 3, 4 to be tilted or inclined relative to the frame 10, and the tracks 3, 4 include a curved or non-linear structure, best shown in FIGS. 4-5 and 7. A pair of pedal mechanisms each include a pedal base 5, 6 slidably attached or mounted on the tracks 3, 4 respectively and movable along the tracks 3, 4 respectively, and each include a supporter 51, 61 for attaching or mounting or supporting a pedal 52, 62 on the pedal base 5, 6 and for supporting the user's legs or feet and for allowing the user to step or move the pedals 52, 62 and the pedal bases 5, 6 along the tracks 3, 4 respectively.

A pair of rocker arm mechanisms each include a rocker arm 7, 8 having an upper end 71, 81 pivotally attached or mounted to the axle rod 14 for swinging or rotating relative to the standing rod 12 of the frame 10 with or around the axle rod 14, and each include a hand grip 70, 80 disposed or provided on top of the respective rocker arm 7, 8 for being grasped or held by the users, and the rocker arms 7, 8 each include a lower end 72, 82 pivotally coupled to a linking rod 73, 83 with a universal connector 74, 84, in which the linking rods 73, 83 are pivotally coupled to the pedal bases 5, 6 with universal connectors 75, 85 respectively for pivotally coupling the pedal bases 5, 6 to the rocker arms 7, 8 and for allowing the pedal bases 5, 6 to be moved up and down along the tracks 3, 4 respectively by swinging the rocker arms 7, 8, or for allowing the rocker arms 7, 8 to be swung or rotated relative to the standing rod 12 of the frame 10 with or around the axle rod 14 by moving the pedal bases 5, 6 along the tracks 3, 4 respectively.

A first transmitting mechanism includes a pulley 91 attached or mounted or secured to the inclined supporting rod 16 or the frame 10 and located near or close to or below the upper ends of the tracks 3, 4, and a steel rope 92 engaged with or engaged around the pulley 91, and the two ends of the steel rope 92 are coupled to the pedal bases 5, 6 respectively for pivotally coupling the pedal bases 5, 6 together and for limiting or guiding the pedal bases 5, 6 to move up and down along the tracks 3, 4 alternatively. For example, when one of the pedal bases 5 is moved downwardly or rearwardly along the track 3, the other pedal base 6 may be moved upwardly or forwardly along the other track 4 by the steel rope 92, and on the contrary, the pedal base 5 may be moved upwardly or forwardly along the other track 3 when the other pedal base 6 is moved downwardly or rearwardly along the track 4.

A second transmitting mechanism includes two linking belts 21, 22 each having one end coupled or connected to the lower ends 72, 82 of the rocker arms 7, 8 respectively, and having the other ends coupled or connected together with an elastic belt 23 for allowing the lower ends 72, 82 of the rocker arms 7, 8 to be coupled or connected together with the linking belts 21, 22 and the elastic belt 23. A shaft rod 24 is rotatably installed or attached or mounted or secured to the frame 10, a belt wheel 25 is installed or attached or mounted to the middle portion of the shaft rod 24, and two gear wheels 26 are installed or attached or mounted to the end portions of the shaft rod 24, in which the gear wheels 26 are attached or mounted to the shaft rod 24 with unidirectional bearings 261 and movable in one direction relative to the shaft rod 24.

The linking belts 21, 22 are meshed or engaged with the teeth of the gear wheels 26 respectively for allowing the shaft rod 24 to be rotated or driven relative to the frame 10 by the linking belts 21, 22. Two rotary wheels 28, 29 are rotatably installed or attached or mounted or secured to the front bottom rod 11, the elastic belt 23 is engaged with or engaged around the rotary wheels 28, 29 and coupled or connected to the linking belts 21, 22 for allowing the lower ends 72, 82 of the rocker arms 7, 8 to be moved back and forth alternatively or rearwardly and forwardly relative to each other. For example, when the lower end 72 of one of the rocker arms 7 is moved forwardly, the lower end 82 of the other rocker arm 8 may be moved rearwardly relative to the frame 10.

A damping mechanism includes a load wheel 101 rotatably installed or attached or mounted or secured to the frame 10 and coupled or connected to the belt wheel 25 with a transmitting belt 103 for coupling or connecting the load wheel 101 to the belt wheel 25 and for allowing the load wheel 101 to be rotated or driven relative to the frame 10 by the belt wheel 25 and the shaft rod 24, and for providing a resistive force to the rocker arms 7, 8. An electro-magnetic brake 102 is also installed or attached or mounted or secured to the frame 10 and located near or close to or beside the load wheel 101 for braking the load wheel 101, and the braking of the load wheel 101 and/or the resistive force to the rocker arms 7, 8 may be selected or controlled or adjusted or operated with the control panel 121.

Figure 6:
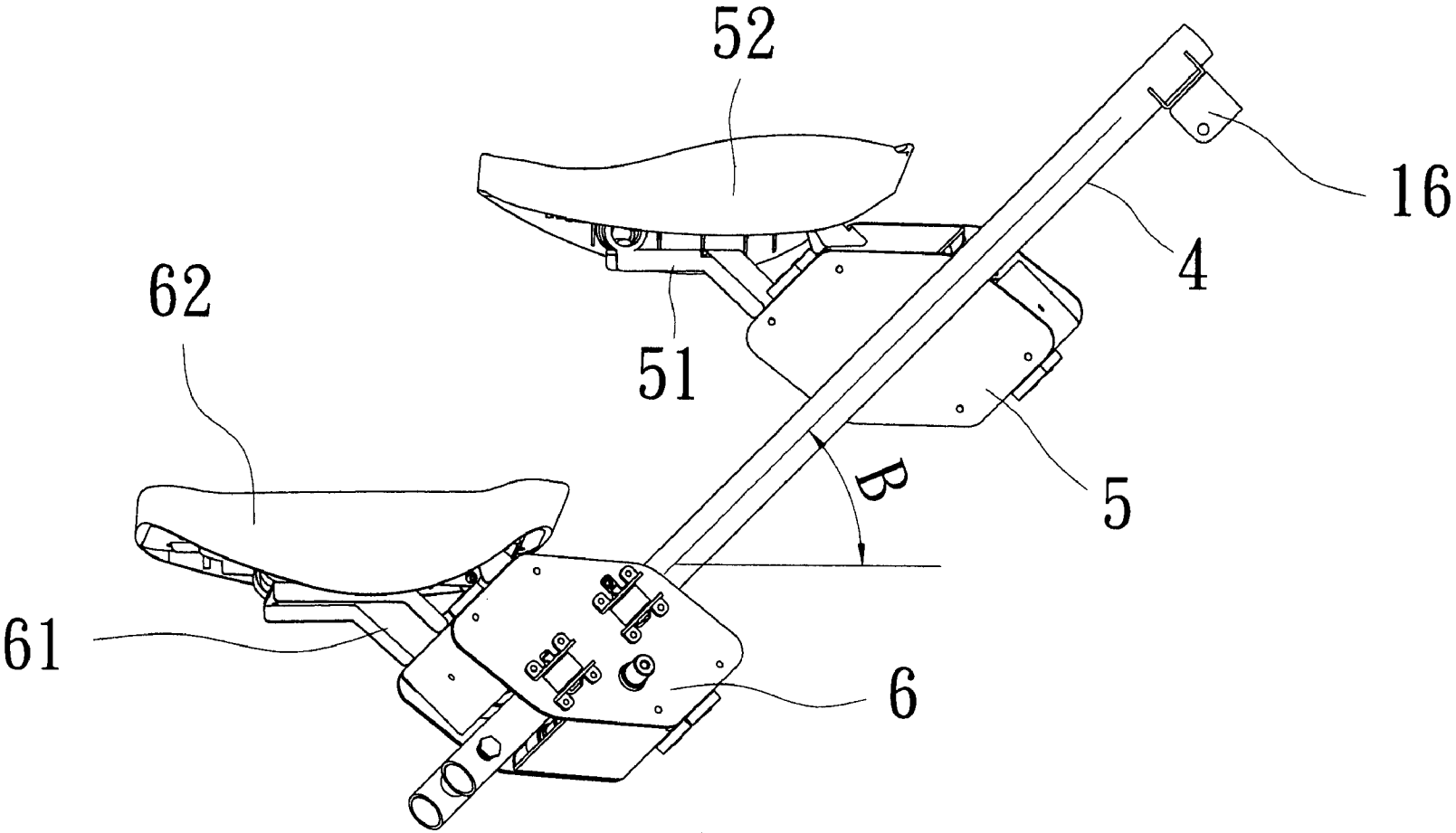
FIG. 6 is a partial side plan schematic view illustrating the tracks and the pedals of the athletic apparatus.

Referring next to FIGS. 4-6, the tracks 3, 4 in accordance with the present invention each include pair of curved pipes 31, 32; 41, 42 which are parallel to each other, and the pipes 31, 32; 41, 42 include upper ends fixed or attached or mounted to a common linking member 161 which is installed or attached or mounted or secured to the upper end or the upper portion of the inclined supporting rod 16, and the pipes 31, 32; 41, 42 of each tracks 3, 4 include the lower ends coupled or connected together with one or more linking members 33, 43 respectively and installed or attached or mounted or secured to the installation portions 131, 132 of the rear bottom rod 13 or of the frame 10 for supporting the tracks 3, 4 at a tilted or inclined angle "B" (FIG. 6) relative to the frame 10.

Referring next to FIG. 7, a center line 17 will be formed between the two oppositely installed tracks 3, 4 and may indicate or represent a longitudinal direction of the supporting base 18, and the tracks 3, 4 each include a curvature or arc length L1, L2 having a curvature center located at O1 and O2 respectively and having a radius r1, r2 respectively, and it is preferable that the radii r1, r2 and the arc lengths L1, L2 of the tracks 3, 4 are equal to each other, and it is preferable that the upper ends 30, 40 of the tracks 3, 4 are located beside or close to each other, or located close to the center line 17, and the lower ends 39, 49 of the tracks 3, 4 are located away from each other, or located distal to or spaced away from the center line 17.

In operation, as shown in FIGS. 1-3 and 8, the user may step on the pedals 52, 62 to move the pedals 52, 62 and the pedal bases 5, 6 along the tracks 3, 4 respectively, and the user may hole or grasp the hand grips 70, 80 of the respective rocker arms 7, 8 for swinging or rotating the rocker arms 7, 8 relative to the standing rod 12 of the frame 10, and the pedal bases 5, 6 may be pivotally coupled to the rocker arms 7, 8 with the linking rods 73, 83 for allowing the pedal bases 5, 6 to be moved up and down along the tracks 3, 4 respectively by swinging the rocker arms 7, 8 (FIGS. 4, 5), and/or for allowing the rocker arms 7, 8 to be swung or rotated relative to the standing rod 12 of the frame 10 with or around the axle rod 14 by stepping or moving the pedal bases 5, 6 along the tracks 3, 4 respectively.

In addition, when the lower ends 72, 82 of the rocker arms 7, 8 are moved back and forth alternatively or rearwardly and forwardly relative to each other, the load wheel 101 may be rotated or driven relative to the frame 10 by the belt wheel 25 and the shaft rod 24, and thus may provide a resistive force to the rocker arms 7, 8 and/or the pedals 52, 62 and the pedal bases 5, 6, such that the user may practice or exercise his upper and lower muscle groups by stepping and moving the pedals 52, 62 and the pedal bases 5, 6 along the tracks 3, 4 respectively, and by pulling or pushing or moving the rocker arms 7, 8 back and forth. As shown in FIG. 5, it is preferable that the pedals 52, 62 are tilted or inclined relative to the pedal bases 5, 6 or the frame 10 for a tilted or inclined angle "A" for allowing the pedals 52, 62 to be suitably or smoothly moved up and down along the tracks 3, 4 respectively.

Accordingly, the athletic apparatus in accordance with the present invention includes a pair of non-linear sliding tracks movable relative to the supporting base and having a pair of foot pedals slidably attached or mounted on the tracks for supporting the user's legs or feet and for allowing the user to conduct an elliptical moving exercise or operation.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An athletic apparatus comprising:

a frame including an axle rod, two rotary wheels rotatably installed on said frame, a pair of tracks disposed on said frame and tilted relative to said frame for a predetermined angle, and each track including a curved and non-linear structure, a pair of pedal mechanisms slidably attached to said tracks and movable along said tracks respectively, and each including a pedal for supporting a user's feet, a pair of rocker arm mechanisms each including a rocker arm having an upper end pivotally attached to said axle rod of said frame and having a lower end pivotally coupled to said pedal mechanisms respectively, a first transmitting mechanism including a pulley attached to said frame and located below upper ends of said tracks, and a steel rope engaged with said pulley and having two ends coupled to said pedal mechanisms respectively for pivotally coupling said pedal mechanisms together and for guiding said pedal mechanisms to move up and down along said tracks respectively, a second transmitting mechanism including two linking belts each having a first end coupled to said lower ends of said rocker arms respectively and each having a second end coupled to an elastic belt, and the elastic belt being engaged with said rotary wheels of said frame for allowing said lower ends of said rocker arms to be coupled together with said linking belts and said elastic belt, a shaft rod installed on said frame, a belt wheel installed on said shaft rod, two gear wheels installed on said shaft rod with unidirectional bearings and engaged with said linking belts respectively.

2. The athletic apparatus as claimed in claim 1, wherein said frame includes a base having a front bottom rod and a rear bottom rod and a middle bottom rod, a standing rod extended upwardly from said base, a control panel disposed on top of said standing rod, said axle rod is attached to said standing rod, a pair of handles attached to said axle rod and said middle bottom rod, and said rear bottom rod includes two installation portions.

3. The athletic apparatus as claimed in claim 2, wherein said frame includes an inclined supporting rod, and said upper ends of said tracks are fixed to said inclined supporting rod, and said tracks include lower ends fixed to said installation portions of said frame for supporting said tracks at a tilted angle relative to said frame.

4. The athletic apparatus as claimed in claim 1, wherein said lower ends of said rocker arms are each pivotally coupled to a linking rod with a universal connector, and said linking rods are pivotally coupled to said pedal mechanisms with universal connectors respectively.

5. The athletic apparatus as claimed in claim 1, wherein said pedal mechanisms each include a pedal base slidably attached on the tracks and movable along the tracks respectively, and each include a supporter for attaching said pedal on the pedal base.

6. The athletic apparatus as claimed in claim 1 further comprising a damping mechanism including a load wheel rotatably installed on said frame and coupled to said belt wheel with a transmitting belt for coupling said load wheel to said belt wheel and for allowing said load wheel to be rotated relative to said frame by said belt wheel and said shaft rod and for providing a resistive force to said rocker arms, and an electro-magnetic brake installed on said frame and located near said load wheel for braking said load wheel.

7. The athletic apparatus as claimed in claim 1, wherein said tracks each include a pair of curved pipes which are parallel to each other.

8. The athletic apparatus as claimed in claim 1, wherein said frame includes a center line formed between said tracks, and said tracks each include an arc length having a curvature center and a radius respectively, and said radii and said arc lengths of said tracks are equal to each other, and said upper ends of said tracks are located close to each other, and said tracks include lower ends located away from each other.

9. The athletic apparatus as claimed in claim 1, wherein said pedals are tilted relative to said pedal bases for a tilted angle.

* * * * *